US008651122B2

(12) United States Patent
Haltmayer et al.

(10) Patent No.: US 8,651,122 B2
(45) Date of Patent: Feb. 18, 2014

(54) WATER-CONDUCTING DOMESTIC APPLIANCE

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 769 days.

(21) Appl. No.: 12/484,451

(22) Filed: Jun. 15, 2009

(65) Prior Publication Data

US 2009/0314315 A1 Dec. 24, 2009

(30) Foreign Application Priority Data

Jun. 20, 2008 (DE) ..... 10 2008 029 368

(51) Int. Cl.
*B08B 3/12* (2006.01)
*B08B 6/00* (2006.01)

(52) U.S. Cl.
USPC ..... 134/200; 134/56 D; 134/57 D

(58) Field of Classification Search
USPC ..... 68/208; 134/200
See application file for complete search history.

(56) References Cited

U.S. PATENT DOCUMENTS

| | | | | | |
|---|---|---|---|---|---|
| 2,302,014 | A | * | 11/1942 | Fausek et al. | 137/85 |
| 2,769,341 | A | * | 11/1956 | De Boisblanc | 73/723 |
| 2,918,191 | A | * | 12/1959 | Pipes et al. | 220/301 |
| 2,982,511 | A | * | 5/1961 | Connor | 251/5 |
| 3,295,541 | A | * | 1/1967 | Ummel | 134/182 |
| 3,640,306 | A | * | 2/1972 | Vogt | 137/512.1 |
| 4,256,136 | A | * | 3/1981 | Crawford | 137/387 |
| 4,418,886 | A | * | 12/1983 | Holzer | 251/30.05 |
| 5,167,248 | A | * | 12/1992 | Tuller | 137/1 |
| 5,251,939 | A | * | 10/1993 | Jordan | 285/24 |
| 5,499,675 | A | * | 3/1996 | Haasch et al. | 165/103 |
| 6,293,289 | B1 | * | 9/2001 | Hapke et al. | 134/58 D |
| 6,349,731 | B1 | * | 2/2002 | Schaaf et al. | 134/114 |
| 6,357,473 | B1 | * | 3/2002 | Porter et al. | 137/512.15 |
| 6,745,723 | B1 | * | 6/2004 | Hicks et al. | 122/14.31 |
| 7,828,014 | B2 | * | 11/2010 | Peric et al. | 137/855 |
| 2005/0274036 | A1 | * | 12/2005 | Osvatic et al. | 34/201 |

FOREIGN PATENT DOCUMENTS

| | | | |
|---|---|---|---|
| DE | 202005019491 | U1 | 3/2006 |
| DE | 10 2005 061 805 | * | 6/2007 |
| DE | 102005062471 | A1 | 7/2007 |
| DE | 102006015498 | A1 | 10/2007 |
| JP | 03-112533 | * | 5/1991 |
| JP | 09-317908 | * | 12/1997 |
| JP | 11-104057 | * | 4/1999 |
| JP | 2002-282187 | * | 10/2002 |
| JP | 2003-090449 | * | 3/2003 |
| JP | 2005-287993 | * | 10/2005 |
| KR | 2005115957 | * | 12/2005 |

OTHER PUBLICATIONS

European Patent Office 0 612 495 Jan. 1994.*

* cited by examiner

*Primary Examiner* — Jason Ko
(74) *Attorney, Agent, or Firm* — James E. Howard; Andre Pallapies

(57) ABSTRACT

A water-conducting domestic appliance includes a container with an expansion opening, an expansion component on the container, and an anti-twist device securing the expansion component in its assembly position.

20 Claims, 2 Drawing Sheets

WATER-CONDUCTING DOMESTIC APPLIANCE

BACKGROUND OF THE INVENTION

Water-conducting domestic appliances of the type cited in the introduction are known. The temperature inside the domestic appliance usually changes during its operation, with an increase in the temperature taking place during a heating phase and a reduction in the temperature taking place during a cooling phase. The increase in temperature causes the air inside the domestic appliance to expand as a result of its density change. The water present in the domestic appliance also expands, particularly if steam is produced with a sufficiently high temperature. The expansion of air as well as water may result in a significant increase in pressure inside the domestic appliance. To avoid damaging the appliance and/or to be able to select an easier design, an expansion opening is frequently provided on the container, which represents the interior of the domestic appliance and/or is connected hereto. To ensure that air, water and/or steam cannot escape in an uncontrolled fashion out of the interior of the domestic appliance through the expansion opening, the expansion opening is covered with an expansion component. This expansion component prevents the uncontrolled escape of air, water and/or steam and feeds water and steam, which condenses back into water with lower temperatures, back to a water circuit of the domestic appliance and/or to the waste water. The expansion component is usually fastened to the container with a centrally arranged screw connection, said container having the expansion opening. The provision of only one screw connection is advantageous in terms of cost-savings. The problem of having to us an assembly template in order to fasten the expansion component in the position and/or angular position provided thus nevertheless occurs during assembly. Crookedly mounted expansion components are frequently identified after assembly. Moving these into the position and/or angular position provided is a time-consuming process. In particular, the release of the screw connection between the expansion component and container, realignment of the expansion component and subsequent tightening of the screw connection are necessary here. It is clear that this process decreases the assembly productivity.

BRIEF SUMMARY OF THE INVENTION

An exemplary embodiment of the invention provides a water-conducting domestic appliance, in which a faulty assembly of expansion components is reliably prevented.

The invention is based on a water-conducting domestic appliance, in particular a dishwasher or washing machine, including a container, which has an expansion opening, on which an expansion component is arranged.

Provision is made in accordance with the invention for an anti-twist device which secures the expansion component in its assembly position. The anti-twist device allows the expansion component to be positioned precisely during assembly. The lengthy correction measures described, which are needed in the case of a faulty assembly, are thus omitted. It has also proven particularly advantageous that loosening of the connection between the expansion component and the container is prevented by means of the anti-twist device. This is particularly relevant during operation of the domestic appliance since the expansion component can be prevented from twisting in respect of the container by means of the vibrations of the domestic appliance and/or by means of the forces brought about by the expansion of air and/or water. As a result, leakages may occur in particular so that air and/or water can escape directly from the container. The anti-twist device prevents the expansion component from twisting in respect of the container about an axis of rotation of the fastening apparatus, with which the expansion component is fastened to the container.

One exemplary embodiment of the invention provides for the anti-twist device to be formed from a projection of the expansion component and a recess which receives the projection and is assigned to the container. This means that the projection engages in the recess of the container and thus prevents the expansion component from twisting in respect of the container. This means that the recess at least partially surrounds the projection so that no freedom of movement or only minimal freedom of movement of the projection is present in the circumferential direction of the expansion component. The recess can be embodied here by the container or assigned thereto. By way of example, the recess can be embodied by a projection of the container.

An exemplary embodiment of the invention provides for the container to have an outer coating, and for the recess to be formed by indentations in the outer coating. This means that an outer coating is provided which is assigned to the container. Provision can be made to initially apply the outer coating to the container and then to embody the recess on the outer coating. The recess is already advantageously embodied before applying the outer coating to the container, so that the recess assigned to the container is embodied during a coating of the container. The outer coating may comprise an equal thickness. Provision may however also be made to increase or reduce the thickness of the outer coating in certain areas. For instance, a greater thickness of the outer coating may be provided in the region of the recess for instance in order to realize a greater holding force of the outer coating in respect of the projection.

An exemplary embodiment of the invention provides to embody the recess as an open-edged clearance in the outer coating. This means that an opening is present at least on one side of the clearance. The projection engages in the clearance through this opening for instance. In the embodiment of the recess, care must generally be taken to prevent the projection from moving in the circumferential direction about an axis of rotation of the fastening facility of the expansion component.

An exemplary embodiment of the invention provides for the outer coating to have an opening running around the expansion opening and for the edge of the opening to have the open-edged clearance. Provision is made for an opening to be embodied in the coating such that this runs around the expansion opening. Provision can be made here for the opening to at least essentially reproduce and/or have a contour of the expansion component. Here the edge of the opening has the open-edged clearance. Provision is advantageously made for the projection to be embodied as a radial projection, which engages in the recess.

An exemplary embodiment of the invention provides for the outer coating to be a bitumen coating, in particular bitumen insulating coating. Here the bitumen insulating coating can be interpreted such that an insulation is provided for thermal purposes and/or to prevent and/or reduce noise. A bitumen coating represents a particularly efficient and cost-effective coating in order to achieve the objectives.

One exemplary embodiment of the invention provides for a material fastening of the outer coating to the container, in particular by means of fusion. In particular, fusion represents a particularly efficient and cost-effective application method for bitumen coatings. A continuous and stable connection is achieved between the outer coating and the container by way of fusion. Planar fusion as well as spot fusion may be provided. In particular, in the case of a container made of metallic material, planar fusion is possible without any problem.

One exemplary embodiment of the invention provides for the expansion component to be fastened to the container with at least one screw connection. Different screw types can be imagined here. It is possible for instance for the screw connection to be realized by way of a screw guided through an outer wall of the container, onto which the expansion component is screwed. One further option is to provide a thread, for instance an outer thread, on the expansion component, whereas a matching inner thread is present in the expansion opening of the container. The expansion component can thus be screwed directly into the expansion opening. Both options describe cost-efficient options for screwing the expansion component to the container. Other types of screw connections (not mentioned here) are however also possible.

An exemplary embodiment of the invention provides for the expansion component to have an expansion tube connecting piece. As described above, overpressure present in the container can be released via the expansion opening. In this way, air, water and/or steam escape through the expansion opening into the expansion component. An expansion tube connecting piece is provided there, through which air, water and/or steam can be drained off. In this way, the expansion tube connecting piece can be provided such that water does not run directly out therefrom but firstly remains in the expansion tube connecting piece by the expansion tube connecting piece being arranged in a vertical fashion and with the opening arranged thereabove. In this way, air and steam can escape, while water is firstly collected in the expansion tube connecting piece and can potentially flow back into the container again.

An exemplary embodiment of the invention provides for the tube connected to the expansion tube connecting piece to be guided by way of a retaining facility provided on the expansion component. Provision is made for a tube to be fastened to the expansion tube connecting piece. This tube allows escaping air, water and/or steam to be made available again to a circuit of the domestic appliance. This is particularly significant for the water and the water condensing out of the steam. Provision can however also be made for the tube to be connected with its end to a drainage water connection. The tube is guided by way of a retaining facility, in order to be able to ensure a precisely defined position of the tube. This may be necessary in order to satisfy the pressure requirements in the system. The retaining facility is provided on the expansion component. This means that no additional component has to be fastened to the container in order to produce a retaining facility for the tube.

An exemplary embodiment of the invention provides for the retaining facility to be arranged on the projection and or to form the projection. This variant represents a cost-efficient and/or material-saving option of realizing the retaining facility. It is even more advantageous for the retaining facility to form the projection, which ensures the expansion component does not twist in respect of the container. Here the projection preferably forms a radial projection of the expansion component. The retaining facility is embodied such that it can securely hold the tube. The retaining facility preferably surrounds the tube at least in part. This thus enables the tube to be introduced into the retaining facility with a certain amount of force, an automatic outward movement can however be virtually ruled out.

An exemplary embodiment of the invention provides for a water feed with a water connecting piece on the expansion component. In order to have to provide the container with as few openings as possible, the expansion opening and/or the expansion component is also used for a water supply. Fresh water can enter the water-conducting domestic appliance by way of this water supply. A water connecting piece is provided here, to which a tube connected on the other side to a fresh water supply can be connected.

The inventive anti-twist device between the expansion component and container can result in a higher assembly quality, in that expansion components attached crookedly and/or at an angle to the container are avoided. At the same time, use of a template during assembly is unnecessary, thereby accelerating said assembly. It is also apparent that the anti-twist device is also extremely advantageous during operation of the domestic appliance, since it prevents a vibration-related twisting of the expansion component in respect of the container for instance and thus the occurrence of leakages. The expansion component can also assume additional functions; for instance, a retaining facility for a tube and/or a water supply can be provided with a water connecting piece.

BRIEF DESCRIPTION OF THE DRAWINGS

The drawings clarify the invention with the aid of an exemplary embodiment, in which.

DETAILED DESCRIPTION OF THE PRESENT INVENTION

Figure 1:
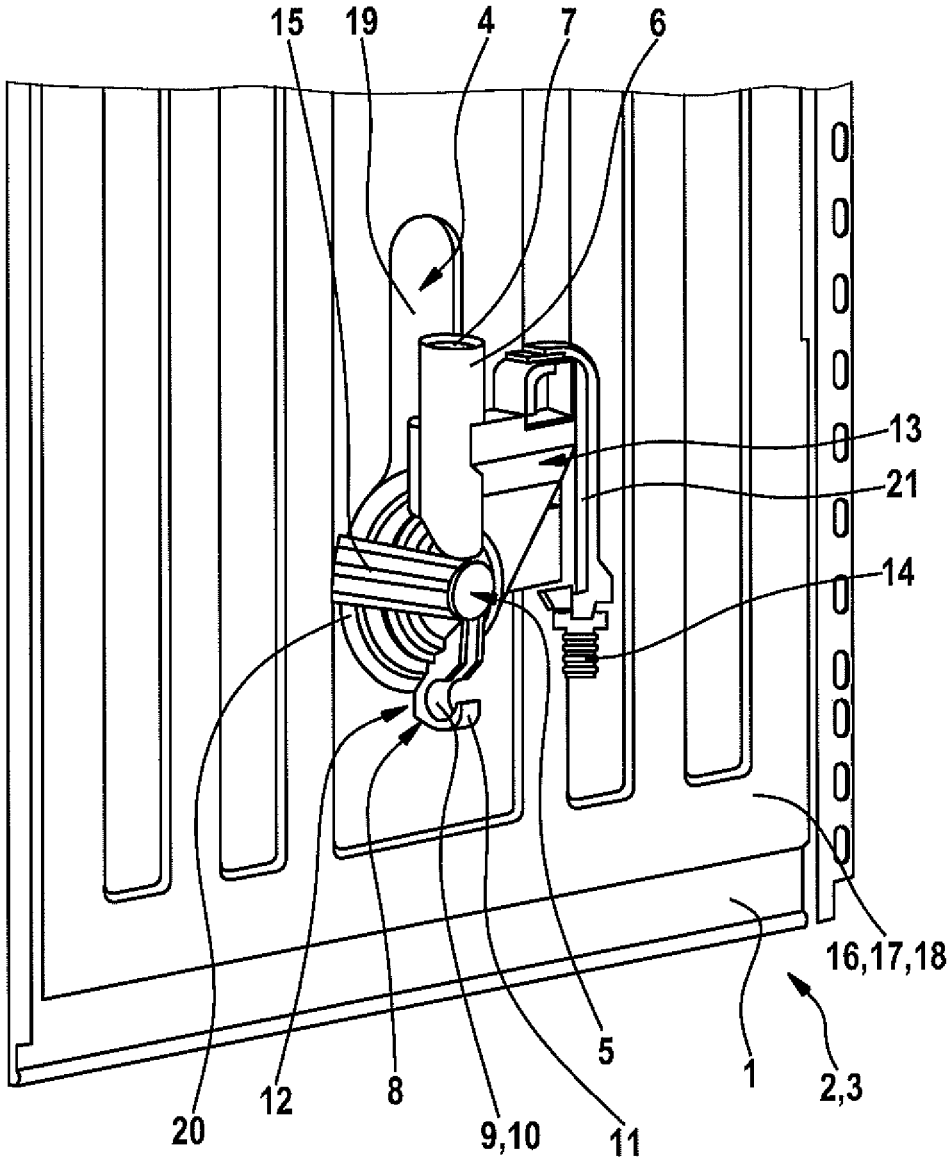
FIG. 1 shows a side view of a container of a water-conducting domestic appliance comprising a bitumen coating and an expansion component.

FIG. 1 shows a rear 1 of a water-conducting domestic appliance 2, in the present exemplary embodiment a dishwasher 3. The dishwasher 3 has a container 4, the interior of which is used as a treatment space for items to be cleaned which can be stored for instance in the extendably mounted cutlery baskets, which are arranged inside the container 4. The container 4 also has an expansion opening; on which an expansion component 5 covering the expansion opening is arranged. The expansion opening is used to balance out pressure differences caused by temperature changes inside the container 4. The expansion component 5 is provided in order to prevent an uncontrolled outflow of air, water and/or steam from the container 4 through the expansion opening. The expansion component 5 is fastened to the container 4 and/or in the expansion opening by means of a screw connection (not shown). The expansion component 5 has an expansion tube connecting piece 6, which is connected to the expansion opening, is essentially aligned vertically in the present exemplary embodiment and has an expansion opening 7 on its upper end. A tube (not shown) is connected to the expansion opening 7, said tube can on the other hand either be fed into the domestic appliance 2 or connected to a drainage water connection. A retaining facility 8, in particular for the tube fastened to the expansion opening 7, is provided on the expansion component 5. The retaining facility 8 is embodied here as a hook 9, in particular as a dog hook 10. The dog hook 10 is manufactured from an elastic material, as a result of which the tube can be easily pushed into the dog hook 10, with the bracket 11 of the dog hook 10 initially elastically receding and moving back into its starting position after pushing in the tube. The dog hook 10 thus at least partially surrounds the circumference of the tube, as a result of which secure retention of the tube is ensured. The retaining facility 8 is simultaneously embodied as a projection 12, which protrudes in the radial direction beyond a scope of the expansion component 5.

The expansion component 5 also has a water supply 13 with a water connecting piece 14. In a top view, the expansion component 5 is essentially circular. The retaining facility 8 with the bracket 11, the expansion tube connecting piece 6 with the expansion opening 7, the water supply 13 with the water connecting piece 14 and a further radial bracket 14 protrude from an outer periphery of the expansion component 5. The radial bracket 15 is used to support the expansion component 5 on the rear 1 of the domestic appliance 2.

The expansion component 5 can be manufactured in one piece in an injection molding method. Plastic can be used as the material for instance. Other suitable materials can however also be used. An outer coating 16 is provided on the rear 1 of the domestic appliance 2 and/or on the container 4. This can be configured as a bitumen coating 17 and/or bitumen insulating coating 18 or made from another suitable material. The outer coating 16 is predominantly used to reduce the noise of the domestic appliance 2 and to thermally insulate the container 4. The outer coating 16 is fastened to the container 4 by means of fusion. The fusion here can take place at least partially in a planar fashion as well as also as spot fusion. The outer coating thickness can also be varied here. In the example shown here, a thickness of the outer coating 16 is however approximately constant. The outer coating 16 has an opening 19, which is provided around the expansion opening. Here the opening 19 broadly represents a circumference of the expansion component 5. Provision is made in particular for the opening 19 to pass around an elevation 20 provided on the container 4. The elevation 20 offsets the expansion component 5 from the rear 1 of the domestic appliance 2. A channel flow 21 of the water supply 13 can be clearly seen on the expansion component 5. The water introduced through the water connecting piece 14 is routed through this to the interior of the container 4.

Figure 2:
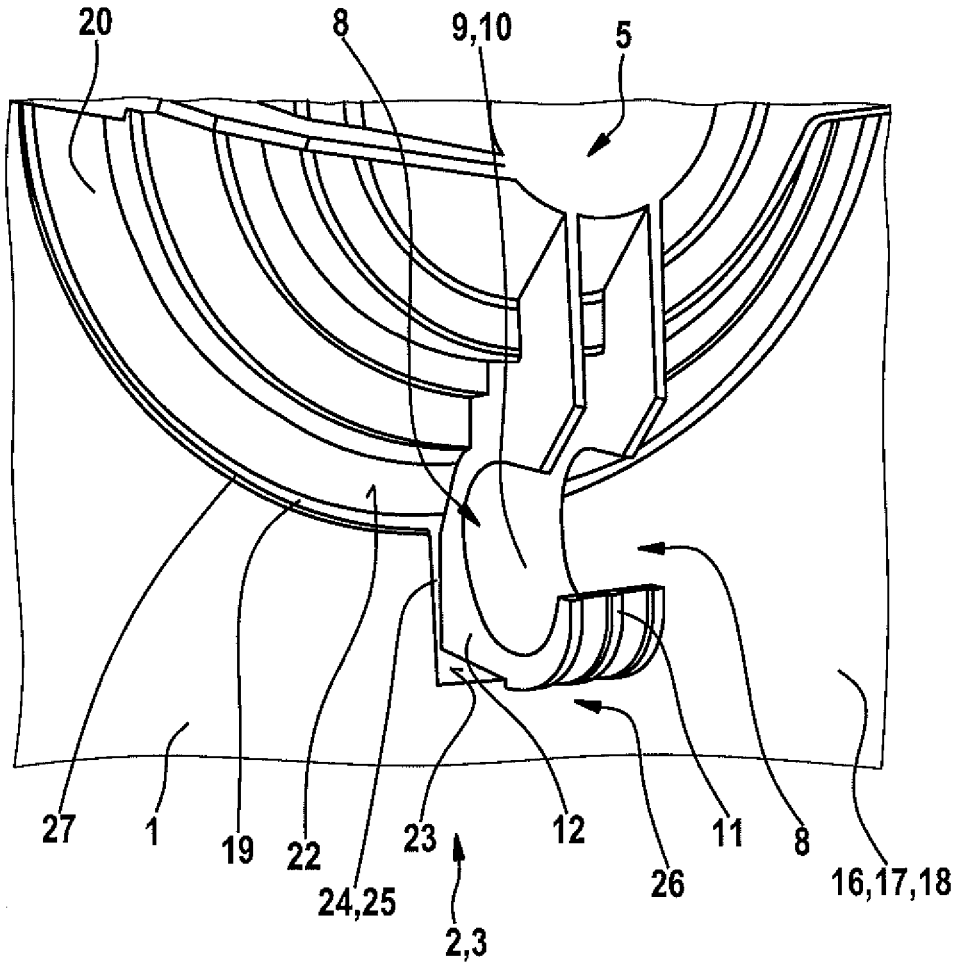
FIG. 2 shows an enlarged representation of the expansion component in FIG. 1.

FIG. 2 shows an enlarged view of the expansion component 5. It is clearly apparent that the expansion component 5 is arranged on the elevation 20 and embodies a projection 12 across a retaining facility 8. The projection 12 runs radially outwards, viewed from the expansion component 5, running along an outer surface 22 of the elevation 20. This course is embodied such that the projection 12 rests at least partially in a planar fashion on a surface 23 of the container 4. Here it engages in a recess 24 embodied in the outer coating 16, said recess being embodied here as an open-edged clearance 25. The open-edged clearance 25 opens with its open edge into the opening 19 of the outer coating 16. In particular, it is possible to determine that the edge 27 of the opening 19 has the open-edged clearance 25. The projection 12 is enclosed by the clearance 25. The projection 12 is restricted in terms of its freedom of movement by a thickness of the outer coating 16. The clearance 25 ideally encloses the projection 12 such that the projection 12 can only be moved marginally in the circumferential direction of the expansion component 5. An anti-twist device 26 of the expansion component 5 in respect of the container 4 is thus produced. Twisting of the expansion component 5 in respect of the container 4 is thus prevented in an effective and cost-efficient fashion.

The invention claimed is:

1. A water-conducting domestic appliance, comprising:

a container including at least one wall having an inner wall surface facing an interior of the container and an outer wall surface facing away from the interior of the container, with an expansion opening formed in the at least one wall;

an expansion component disposed on the outer wall surface of the container and operatively associated with the expansion opening, the expansion component being mounted at a single predetermined orientation with respect to the at least one wall; and device for preventing rotation of the expansion component with respect to the container for securing the expansion component in a predetermined relationship with the expansion opening and the container, the device having a projection formed as a portion of the expansion component and a recess formed in the at least one wall as a portion of the expansion opening, wherein the projection extends into the recess and abuts a wall forming the recess and remains within the recess to both fix the expansion component at the single predetermined orientation and to prevent rotation of the expansion component therefrom.

2. The water-conducting domestic appliance of claim 1, wherein the device for preventing rotation includes a projection of the expansion component and a recess which receives the projection and is formed as a portion of the at least one wall.

3. The water-conducting domestic appliance of claim 2, wherein the container includes an outer coating applied thereto, and the recess is formed by at least one indentation in the outer coating.

4. The water-conducting domestic appliance of claim 3, wherein the recess includes an open-edged clearance formed in the outer coating.

5. The water-conducting domestic appliance of claim 3, wherein the outer coating includes an opening extending around the expansion opening.

6. The water-conducting domestic appliance of claim 4, wherein an edge of the opening has the open-edged clearance.

7. The water-conducting domestic appliance of claim 3, wherein the outer coating includes a bitumen insulating coating.

8. The water-conducting domestic appliance of claim 3, wherein the outer coating is fixed to the container by a fusion process.

9. The water-conducting domestic appliance of claim 1, wherein the expansion component is fastened to the container using a screw connection.

10. The water-conducting domestic appliance of claim 1, wherein the expansion component includes an expansion tube connecting piece.

11. The water-conducting domestic appliance of claim 10, further comprising a tube connected to the expansion tube connecting piece that is guided by way of a holding facility provided on the expansion component.

12. The water-conducting domestic appliance of claim 11, wherein the holding facility is arranged on a projection or forms a projection.

13. The water-conducting domestic appliance of claim 1, further comprising a water supply with a water connecting piece on the expansion component.

14. The water-conducting domestic appliance of claim 1, and further comprising a fastener retaining the expansion component against at least one wall of the container.

15. A water-conducting domestic appliance, comprising:

a container with an expansion opening formed therein and an outer coating applied thereto;

an expansion component on the container and operatively associated with the expansion opening; and a device for stopping rotation of the expansion component with respect to the container for securing the expansion component in a predetermined relationship with the expansion opening and the container, wherein the device for stopping rotation includes a projection of the expansion component and a recess formed by at least one indentation in the outer coating which receives the projection and is operatively associated with the container.

16. The water-conducting domestic appliance of claim 15, wherein the recess includes an open-edged clearance formed in the outer coating.

17. The water-conducting domestic appliance of claim 15, wherein the outer coating includes an opening extending around the expansion opening.

18. The water-conducting domestic appliance of claim 16, wherein an edge of the opening has the open-edged clearance.

19. The water-conducting domestic appliance of claim 15, wherein the outer coating includes a bitumen insulating coating.

20. The water-conducting domestic appliance of claim 15, wherein the outer coating is fixed to the container by a fusion process.

* * * * *